US008841530B2

(12) United States Patent
Geoghegan

(10) Patent No.: US 8,841,530 B2
(45) Date of Patent: Sep. 23, 2014

(54) FLUTE HEADJOINT

(76) Inventor: Michael Geoghegan, Moretown, VT (US)

( * ) Notice: Subject to any disclaimer, the term of this patent is extended or adjusted under 35 U.S.C. 154(b) by 353 days.

(21) Appl. No.: 13/155,524

(22) Filed: Jun. 8, 2011

(65) Prior Publication Data

US 2011/0296972 A1 Dec. 8, 2011

Related U.S. Application Data

(60) Provisional application No. 61/352,689, filed on Jun. 8, 2010.

(51) Int. Cl.
*G10D 9/04* (2006.01)
*G10D 7/02* (2006.01)
*G10D 9/02* (2006.01)

(52) U.S. Cl.
CPC . *G10D 9/02* (2013.01); *G10D 7/026* (2013.01)
USPC ..... 84/384

(58) Field of Classification Search
USPC ..... 84/380 R, 384
See application file for complete search history.

(56) References Cited

U.S. PATENT DOCUMENTS 2,032,685 A * 3/1936 Coe ..... 228/131
2,697,298 A * 12/1954 Bacon ..... 446/200
3,447,230 A * 6/1969 Bargainnier et al. ..... 419/38
3,558,797 A * 1/1971 Wolford ..... 84/384
4,800,635 A 1/1989 Drelinger
4,896,579 A * 1/1990 Goosman ..... 84/384
4,970,931 A * 11/1990 Culbreath ..... 84/384
6,124,538 A 9/2000 Landell
2007/0095194 A1 5/2007 Moerth
2008/0314226 A1 12/2008 Shibata

OTHER PUBLICATIONS http://www.carolinaclarinet.org/mpc_matl.pdf; Brent Smith Jan. 31, 2009.*
International Application No. PCT/US2011/039577, International Search Report and Written Opinion mailed on Sep. 22, 2011, 11 Pages.
International Patent Application No. PCT/US2011/039577, International Preliminary Report on Patentability issued Dec. 10, 2012 (7 pages).

* cited by examiner

*Primary Examiner* — Kimberly Lockett
(74) *Attorney, Agent, or Firm* — Kilpatrick Townsend & Stockton LLP

(57) ABSTRACT

A flute headjoint includes a chimney, a lip plate and a tube body formed from a refractory metal. The refractory metal can include tantalum, niobium, molybdenum, tungsten, rhenium, alloys of these metals and combinations thereof. The chimney and lip plate are attached to the tube body without the use of solder. In certain embodiments, the chimney and lip plate are attached to the tube body with bands. The use of refractory metals in the construction of the tube body may provide enhanced headjoint performance, and because the lip plate and chimney are not soldered to the tube body the components may be formed using a computer modeling and milling process that provides for accurate and consistent production of headjoint components.

19 Claims, 6 Drawing Sheets

FLUTE HEADJOINT

CROSS REFERENCE TO RELATED APPLICATION

This application claims the benefit of U.S. Provisional application Ser. No. 61/352,689, filed Jun. 8, 2010, the entire contents of which are incorporated herein by reference.

FIELD

The present invention relates to flute headjoint constructions, and in particular to metals used in the headjoint components and to methods of attaching the headjoint components to one another.

BACKGROUND

A flute generally includes three main parts: a headjoint, a centerjoint, and a footjoint. The flute headjoint is the portion of the musical instrument comprised of a length of tube (referred to as the headjoint tube) having one closed end and one open end which is fitted to the centerjoint (also referred to as the main body of the flute). The footjoint connects to the centerjoint/main body.

The headjoint further includes a holed lip plate mounted on the top of the headjoint tube by way of a chimney, which is a short length of tube extending between and connecting the lip plate and the headjoint tube. The lip plate hole, the chimney, and a hole through the top of the headjoint tube define an air passage between the lip plate hole and the interior of the headjoint tube. This passage is called the blow hole.

A high quality headjoint has a tonal quality determined by empirical manufacturing techniques. High quality headjoints are made by master craftsmen and are very expensive.

Traditional headjoint manufacturing techniques are imprecise. The geometry of the passageway through the chimney is critical to sound quality. Typically, the chimney is manufactured with the desired geometry. A first end of the chimney is then soldered to a lip plate devoid of a hole. After the chimney is soldered to the lip plate, the lip plate hole is carved by hand in the lip plate to approximate the shape and dimension of the chimney passageway at the first end of the chimney.

The chimney-lip plate assembly is then soldered to a holeless headjoint tube. More specifically, a second end of the chimney is soldered to the headjoint tube. Again, the craftsman must then carve a hole in the headjoint tube that attempts to approximate the shape and dimension of the chimney passageway at the second end of the chimney. In this way, the lip plate hole, passageway through the chimney, and the hole in the headjoint tube align to form the blow hole.

The geometry of the blow hole (and thus the shape of the holes in the lip plate and the headjoint tube) is essential to create a pure and consistent sound. However the method by which these holes are made (i.e., handmade) injects variability into the manufacturing process, rendering it virtually impossible to accurately and consistently reproduce headjoints having the desired dimensions.

Moreover, traditional manufacturing techniques limit the universe of metals available for manufacture into a flute headjoint and more specifically into a headjoint tube. The density, hardness, and workability of a metal is critical to the ultimate manufacture and performance of the high quality headjoint and particularly the headjoint tube. Flute headjoints have been made traditionally from sterling silver, gold, platinum, and stainless steel.

Other materials exist, however, with density and hardness characteristics equal or superior to gold, silver, platinum, and stainless steel. Such materials include, but are not limited to, tantalum, niobium and other refractory group metals. These materials present a problem when assembling the headjoint tube with the rest of the headjoint according to traditional methods, however. More specifically, the surfaces of these metals are relatively inert—they lack cohesion and therefore cannot be soldered or brazed. Because these materials are not conducive to traditional headjoint bonding techniques (i.e., soldering), and other available bonding techniques such as epoxies or adhesives do not provide a strong enough bond to hold the chimney to the tube, these materials have been considered unsuitable for use in flute headjoints and more particularly in the headjoint tube body. Thus, it would be desirable to provide a headjoint that can be assembled by means other than soldering so as to make available materials that have heretofore been unsuitable for use in headjoints.

In addition, the soldering process softens the headjoint tube. Since hardness is another critical requirement for the performance of a high quality headjoint, soldering actually reduces the performance of the flute. Accordingly, alternative methods for connecting the chimney to the headjoint tube would also be desirable.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

In one embodiment, a flute headjoint includes a chimney, a lip plate and a tube body formed from a refractory metal. The refractory metal can include tantalum, niobium, molybdenum, tungsten, rhenium, alloys of these metals and combinations thereof.

In an embodiment, the chimney and lip plate are attached to the tube body without the use of solder. In other embodiments, the chimney and lip plate are attached to the tube body with bands. In yet other embodiments, the chimney and lip plate may be screwed, bolted or press-fit to the tube body.

More specifically, in certain embodiments the chimney includes a first end and a second end, and the lip plate is soldered or adhered to the first end of the chimney, and the second end of the chimney is attached to the tube body without the use of solder.

In some embodiments the lip plate includes a lip hole for receiving the first end of the chimney and the tube body includes a tube hole for receiving the second end of the chimney. The lip hole and tube hole may be formed by a computer modeling and milling process.

In certain embodiments, the first end of the chimney includes an upraised lip that mates with the lip hole in the lip plate, and the second end of the chimney includes an upraised lip that mates with the tube hole in the tube body.

BRIEF DESCRIPTION OF THE FIGURES

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
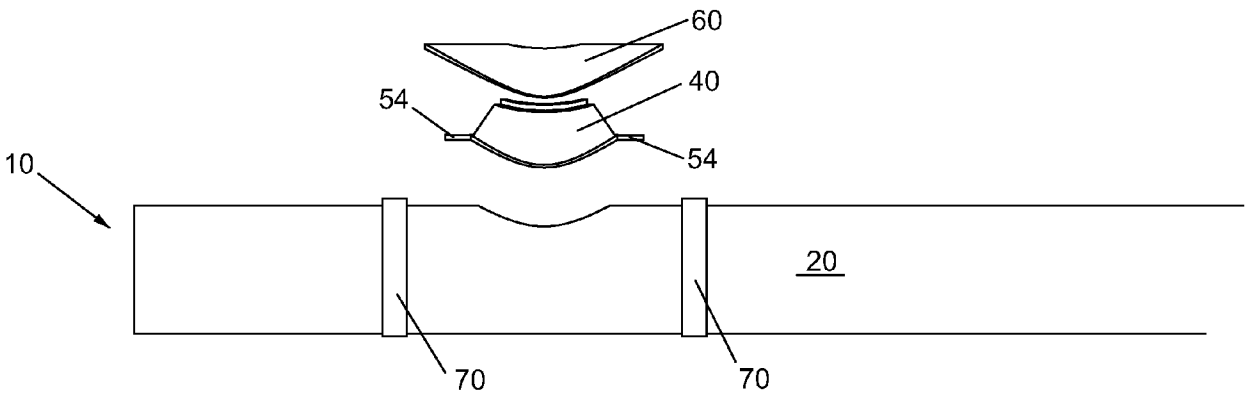
FIG. 1 is an exploded side elevation view of a flute headjoint according to one embodiment of the invention.
Figure 2:
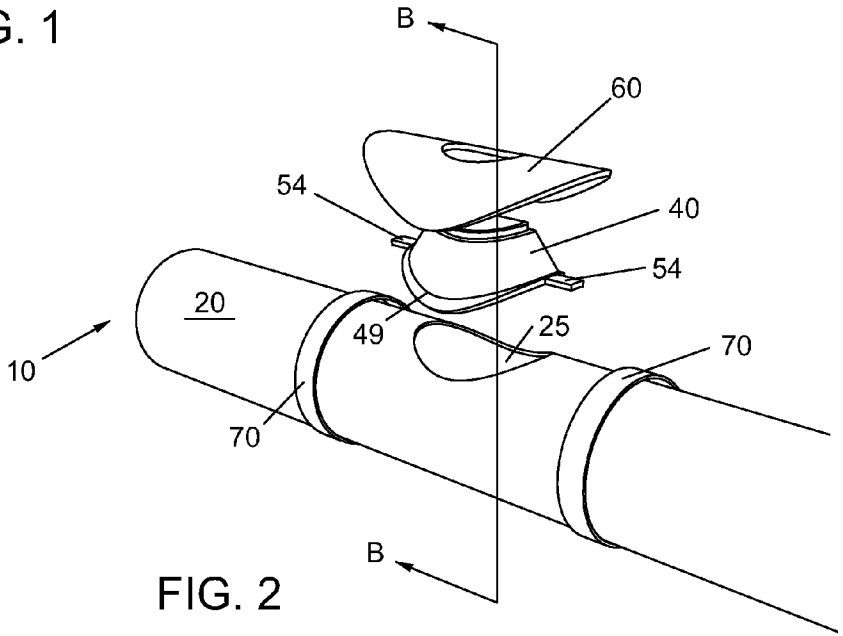
FIG. 2 is an exploded top perspective view of the flute headjoint of FIG. 1.
Figure 4:
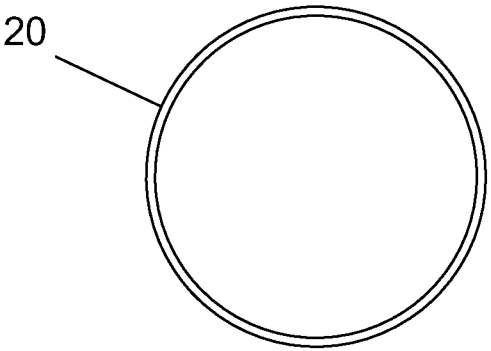
FIG. 4 is a cross-sectional view taken along line A-A in FIG. 3.
Figure 3:
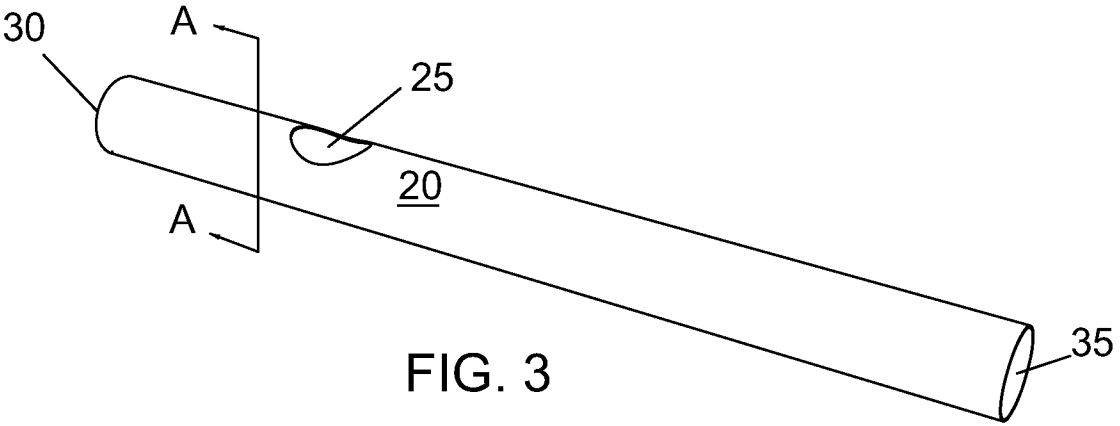
FIG. 3 is a top perspective view of a tube body according to one embodiment of the invention.
Figure 5:
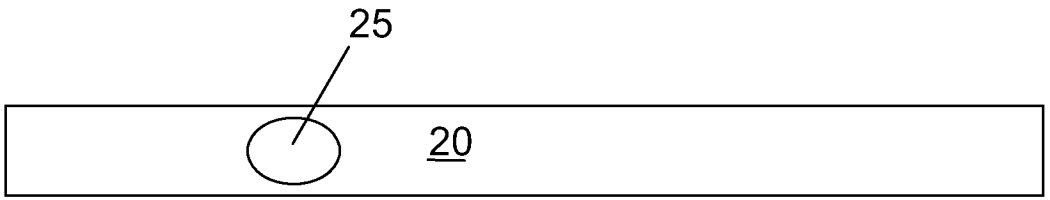
FIG. 5 is a top plan view of the tube body of FIG. 3.
Figure 7:
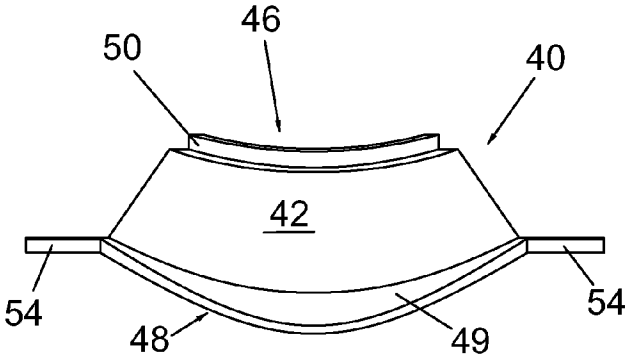
FIG. 7 is a side elevation view of the chimney of FIG. 6.
Figure 9:
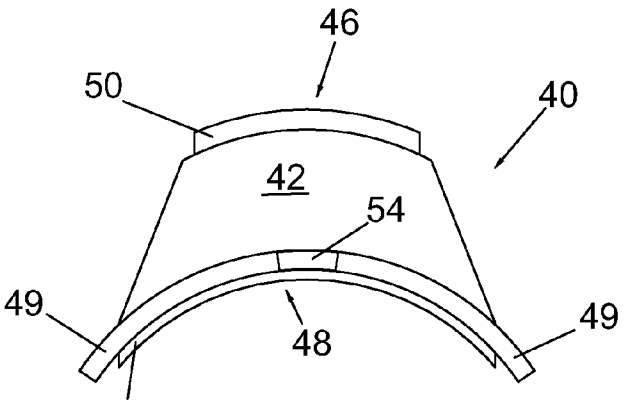
FIG. 9 is an end view of the chimney of FIG. 6.
Figure 6:
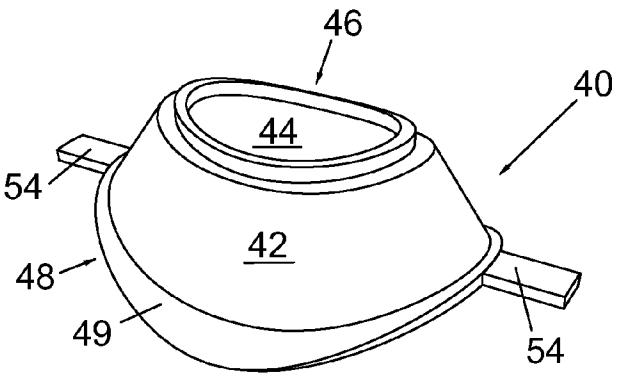
FIG. 6 is a top perspective view of a chimney according to one embodiment of the invention.
Figure 8:
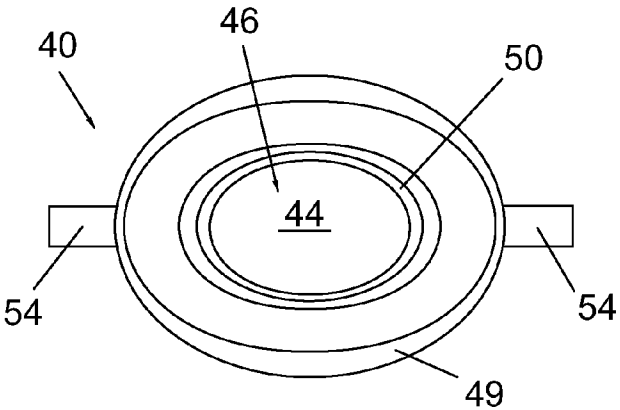
FIG. 8 is a top plan view of the chimney of FIG. 6.

Embodiments of this invention include a flute having a chimney that is not soldered to a headjoint tube. As illustrated in FIGS. 1 and 2, a flute headjoint 10 according to one embodiment of the present invention includes tube body 20, a chimney 40 and a lip plate 60. As shown in FIGS. 3-5, the tube body 20 includes a tube hole 25 configured to receive the chimney 40. The tube body 20 is closed on one end 30 by way of a conventional stopper (not shown), and open on the other end 35 so that it can receive the centerjoint (main body) of the flute (not illustrated).

With reference to FIGS. 6-9, the chimney 40 includes a chimney body 42 that defines a passageway 44. The dimensions of the passageway may be formed as desired but typically will not be consistent along the length of the passageway. Rather, the passageway opening on a first end 46 of the chimney 40 will likely be smaller than the passageway opening on a second end 48 of the chimney 40. An upraised lip 50, 52 may be provided on each end 46, 48 of the chimney body. Moreover, tabs 54 may extend outwardly from the chimney proximate the second end 48 of the chimney 40. The second end 48 of the chimney 40 may have a brim 49 that may be, but does not have to be, shaped to conform to the outer contour of the tube body 20.

Figure 10:
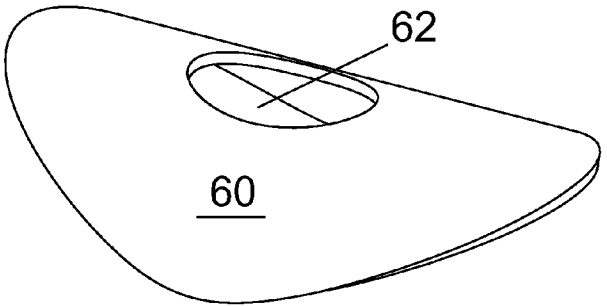
FIG. 10 is a top perspective view of a lip plate according to one embodiment of the invention.
Figure 11:
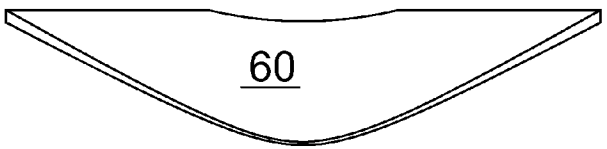
FIG. 11 is a side elevation view of the lip plate of FIG. 10.
Figure 12:
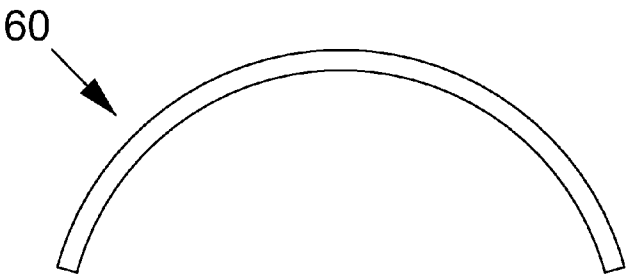
FIG. 12 is an end view of the lip plate of FIG. 10.
Figure 14:
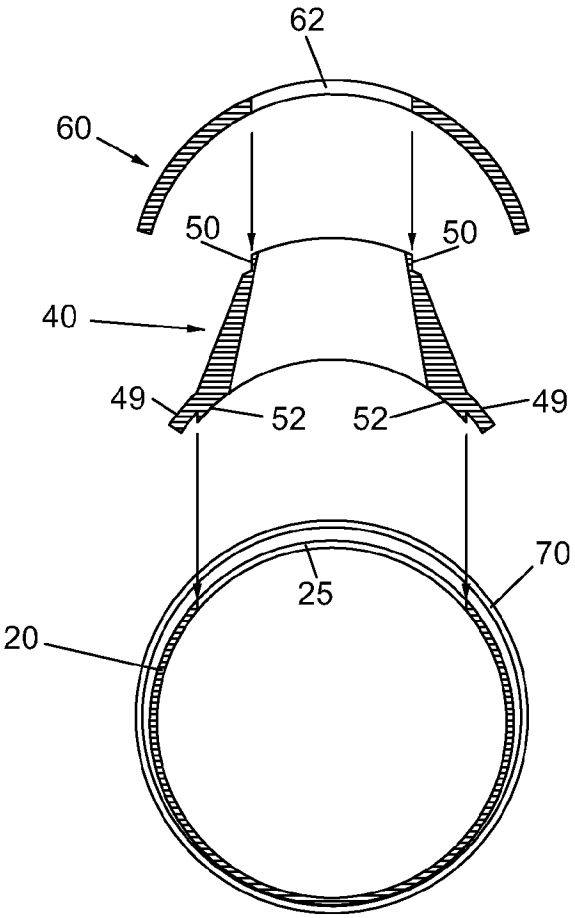
FIG. 14 is an exploded cross-sectional view of a flute headjoint taken along line B-B in FIG. 2.
Figure 13:
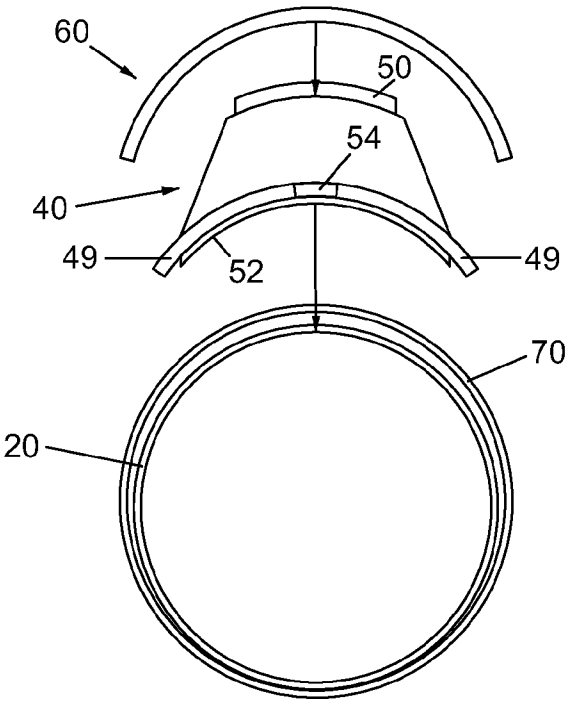
FIG. 13 is an exploded end view of a flute headjoint according to an embodiment of the invention.

With reference to FIGS. 10-12, lip plate 60 includes a lip hole 62 for receiving the upraised lip 50 on the first end 46 of the chimney 40. The lip plate 60 is shaped as desired for the comfort of the user and also to affect to a certain extent the angle at which air can be blown into the flute.

While a variety of manufacturing techniques may be used, in one embodiment the chimney 40 may be consistently reproduced using computer modeling to create (such as via milling) a wax model of the desired chimney and lost wax casting to create a mold for manufacturing the chimney. Again, however, other manufacturing techniques are also suitable.

Similarly and in contrast to traditional techniques, the tube hole 25 and lip hole 62 may also be formed via computer modeling and milling. Such methods impart precision to these hole geometries and may be performed prior to attachment of the parts to the flute headjoint 10.

After the headjoint parts are formed, the chimney 40 and lip plate 60 are mated such that the upraised lip 50 on the first end 46 of the chimney 40 engages the lip hole 62 on the lip plate 60 to register the chimney 40 on the lip plate 60. The chimney 40 and lip plate 60 are then attached together. The chimney 40 and lip plate 60 may be formed of traditional or any other suitable materials and may be soldered or otherwise adhered or attached together. Exemplary suitable materials for the chimney and lip plate include, but are not limited to, gold, silver, platinum, and stainless steel.

With reference to FIGS. 1, 2, 13 and 14, the chimney 40 and lip plate 60 are attached to the tube body 20. More specifically, the upraised lip 52 on the second end 48 of the chimney 40 engages the tube hole 25 in the tube body 20.

Figure 15:
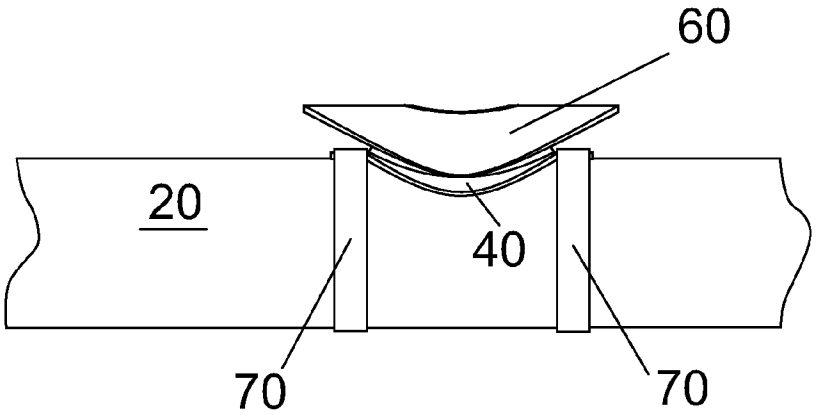
FIG. 15 is a side elevation view of a flute headjoint according to one embodiment of the invention.
Figure 16:
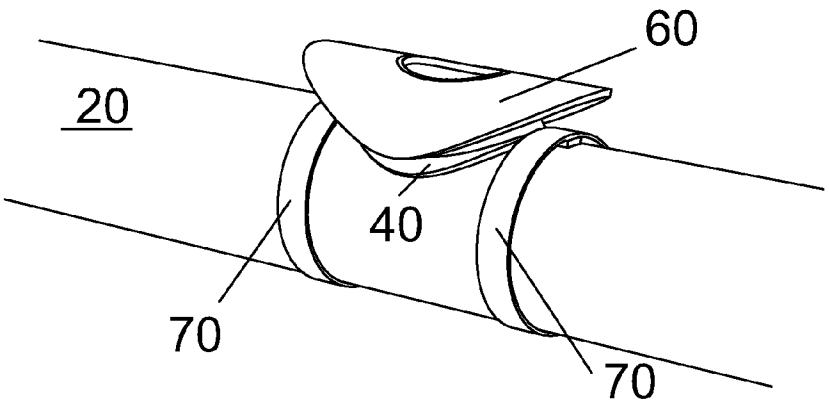
FIG. 16 is top perspective view of the flute headjoint of FIG. 15.

As illustrated in FIGS. 15 and 16, the chimney 40 and lip plate 60 may be secured to the tube body 20 by bands 70, which cover the tabs 54 of the chimney 40 and go around the tube body 20. The bands 70 may be press-fitted to stretch and hold the tabs 54 down, and simultaneously compress the tube body 20 just below and around the chimney 40. This compression adds to the resonating ability of the flute headjoint 10 and enhances its performance. The bands 70 may be made of a material having a suitable structural integrity, including but not limited to sterling silver.

Although the figures and description refer specifically to bands, other suitable methods for attaching the chimney 40 and lip plate 60 to the tube body 20 are contemplated within the scope of the present invention. For example, these components could be screwed, bolted, press-fit or otherwise attached to the tube body 20 by any other method that does not require the use of soldering or adhesives.

Further, since the bands 70 secure the chimney 40 to the tube body 20 without the need for soldering or adhesives, the tube body may be formed from materials that have not previously been used in flute headjoint constructions. Such materials include, but are not limited to, refractory metals. Refractory metals include, but are not limited to, tantalum, niobium, molybdenum, tungsten and rhenium. These metals may provide enhanced headjoint performance. In other embodiments, the tube body may be formed from combinations (alloys) of these refractory metals. In yet other embodiments, the tube body may be formed from alloys of refractory metals with other, non-refractory metals.

In certain embodiments, the tube body is formed from tantalum. In other embodiments, the tube body is formed from niobium.

Moreover, because the headjoint tube is not soldered and thus not exposed to any heat, it does not lose any of its hardness thus retaining the resonant quality of the completed headjoint.

The embodiments described herein allow for pure and consistent reproduction of sound by using a computer modeling and machine milling to design and manufacture the chimney 40 and create appropriately sized holes in the lip plate 60 and tube body 20 prior to assembling the flute headjoint 10. Further, the present invention allows for the use of superior sound and performance producing materials without soldering or adhesive methods.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

I claim:

1. A flute headjoint comprising a chimney, a lip plate and a tube body, wherein the tube body comprises a refractory metal selected from the group consisting of tantalum, niobium, molybdenum, tungsten, rhenium, alloys of these metals and combinations thereof.

2. The flute headjoint according to claim 1, wherein the refractory metal is tantalum.

3. The flute headjoint according to claim 1, wherein the refractory metal is niobium.

4. The flute headjoint according to claim 1, wherein the chimney and lip plate are secured to the tube body without the use of solder.

5. The flute headjoint according to claim 1, wherein the chimney and lip plate are secured to the tube body with bands.

6. The flute headjoint according to claim 1, wherein the chimney and lip plate are screwed or bolted to the tube body.

7. A flute headjoint comprising a chimney, a lip plate and a tube body, the chimney comprising a first end and a second end, wherein the lip plate is soldered or adhered to the first end of the chimney, and wherein the second end of the chimney is secured to the tube body without the use of solder.

8. The flute headjoint according to claim 7, wherein the tube body comprises a refractory metal.

9. The flute headjoint according to claim 8, wherein the refractory metal is selected from the group consisting of tantalum, niobium, molybdenum, tungsten, rhenium, alloys of these metals and combinations thereof.

10. The flute headjoint according to claim 7, wherein the lip plate includes a lip hole for receiving the first end of the chimney and the tube body includes a tube hole for receiving the second end of the chimney.

11. The flute headjoint according to claim 10, wherein the lip hole and tube hole are formed by a computer modeling and milling process.

12. The flute headjoint according to claim 10, wherein the first end of the chimney includes an upraised lip that is received within the lip hole in the lip plate, and wherein the second end of the chimney includes an upraised lip that is received within the tube hole in the tube body.

13. The flute headjoint according to claim 7, wherein the second end of the chimney is secured to the tube body with bands.

14. A flute headjoint, comprising:

a lip plate comprising gold, silver, platinum, stainless steel or combinations thereof, wherein the lip plate comprises a lip hole that is formed from a computer modeling and milling process;

a chimney comprising gold, silver, platinum, stainless steel or combinations thereof, wherein the chimney is formed from a computer modeling and milling process and includes an upraised lip on a first end of the chimney and an upraised lip on a second end of the chimney; and a tube body comprising a refractory metal and comprising a tube hole formed from a computer modeling and milling process, wherein the lip hole of the lip plate receives the upraised lip on the first end of the chimney and the lip plate and chimney are soldered to each other, and wherein the tube hole of the tube body receives the upraised lip on the second end of the chimney, and the chimney is secured to the tube body with bands.

15. The flute headjoint according to claim 1, wherein the lip plate is secured to the chimney and the chimney is removably secured to the tube body.

16. The flute headjoint according to claim 1, wherein the refractory metal is selected from the group consisting of tantalum, niobium, molybdenum, rhenium, alloys of these metals and combinations thereof.

17. The flute headjoint according to claim 7, wherein the tube body comprises a refractory metal selected from the group consisting of tantalum, niobium, molybdenum, rhenium, alloys of these metals and combinations thereof.

18. The flute headjoint according to claim 7, wherein the second end of the chimney is removably secured to the tube body.

19. The flute headjoint according to claim 7, wherein the second end of the chimney is secured to the tube body without the use of adhesive.

* * * * *